US012134880B2

(12) United States Patent
Hartvig Andersen

(10) Patent No.: US 12,134,880 B2
(45) Date of Patent: Nov. 5, 2024

(54) POSITION DETECTION DEVICE AND METHOD FOR DETECTING THE POSITION OF A BUCKET OF AN EXCAVATOR

(71) Applicant: Unicontrol ApS, Odense M (DK)

(72) Inventor: Kasper Hartvig Andersen, Vester Skerninge (DK)

(73) Assignee: Unicontrol ApS, Odense M (DK)

( * ) Notice: Subject to any disclaimer, the term of this patent is extended or adjusted under 35 U.S.C. 154(b) by 188 days.

(21) Appl. No.: 17/667,740

(22) Filed: Feb. 9, 2022

(65) Prior Publication Data

US 2022/0267999 A1 Aug. 25, 2022

Related U.S. Application Data

(63) Continuation of application No. PCT/DK2020/050231, filed on Aug. 11, 2020.

(30) Foreign Application Priority Data

Aug. 13, 2019 (DK) ..... PA 2019 00955

(51) Int. Cl.
*E02F 9/26* (2006.01)
*E02F 3/32* (2006.01)
*E02F 3/38* (2006.01)

(52) U.S. Cl.
CPC ..... *E02F 9/264* (2013.01); *E02F 3/325* (2013.01); *E02F 3/384* (2013.01)

(58) Field of Classification Search
CPC . E02F 3/325; E02F 3/384; E02F 3/435; E02F 9/264
See application file for complete search history.

(56) References Cited

U.S. PATENT DOCUMENTS 5,348,105 A * 9/1994 Lappalainen ..... E21B 7/025 175/24
5,383,524 A * 1/1995 Rinnemaa ..... E21B 7/022 173/1
6,099,235 A 8/2000 Cain et al.
7,644,782 B1 1/2010 Coogan et al.
(Continued)

FOREIGN PATENT DOCUMENTS

CA 2635148 A1 12/2008
EP 1141511 A1 10/2001
(Continued)

*Primary Examiner* — Tyler J Lee
(74) *Attorney, Agent, or Firm* — Elevated IP, LLC

(57) ABSTRACT

A position detection device for detecting the position of a bucket of an excavator having a cab and one or more booms is disclosed. A boom is rotatably attached to the cab by a mounting structure that is rotatably attached to the cab by a shaft having a longitudinal axis extending basically vertically during normal use of the excavator. The bucket is rotatably mounted to a stick that is rotatably attached to the boom. The mounting structure is arranged and configured to allow the boom to be rotated with respect to the longitudinal axis of the shaft. The position detection device comprises one or more antennas arranged and configured to receive satellite signals. The position detection device comprises a sensor assembly configured to detect the angular position of the boom with respect to rotation about the longitudinal axis of the shaft.

17 Claims, 11 Drawing Sheets

(56) References Cited

U.S. PATENT DOCUMENTS

| | | | | |
|---|---|---|---|---|
| 7,925,439 | B2 | 4/2011 | McCain | |
| 8,122,974 | B2 * | 2/2012 | Kosoric | E21B 7/025 173/4 |
| 9,739,136 | B2 * | 8/2017 | Tuunanen | E21B 7/02 |
| 11,401,699 | B2 * | 8/2022 | Olsson | E02F 9/2004 |
| 2006/0124323 | A1 | 6/2006 | Glover et al. | |
| 2011/0311342 | A1 | 12/2011 | Montgomery | |
| 2013/0164105 | A1 | 6/2013 | Scherf et al. | |
| 2015/0267382 | A1 | 9/2015 | Ikegami et al. | |
| 2018/0245317 | A1 | 8/2018 | Ready-Campbell et al. | |

FOREIGN PATENT DOCUMENTS

| | | | |
|---|---|---|---|
| EP | 2503062 | A2 | 9/2012 |
| JP | H08166233 | A | 6/1996 |
| JP | 2004043168 | A | 2/2004 |
| JP | 2004044375 | A | 2/2004 |
| JP | 2013117139 | A | 6/2013 |
| JP | 2014524030 | A | 9/2014 |
| WO | 2014167722 | A1 | 10/2014 |

* cited by examiner 6
32
14
34
α
8
4

6
14
34
32
8
4
α

| Angle [°] | 162.2 | 144.3 | 126.5 | 108.1 | 90.2 | 71.9 | 54.2 | 36.8 | 18.2 |
|---|---|---|---|---|---|---|---|---|---|
| Sensor data (e.g. mm) | 62.2 | 64.4 | 66.2 | 68.3 | 70.2 | 72.4 | 74.6 | 78.2 | 80.4 |
Fig. 11A
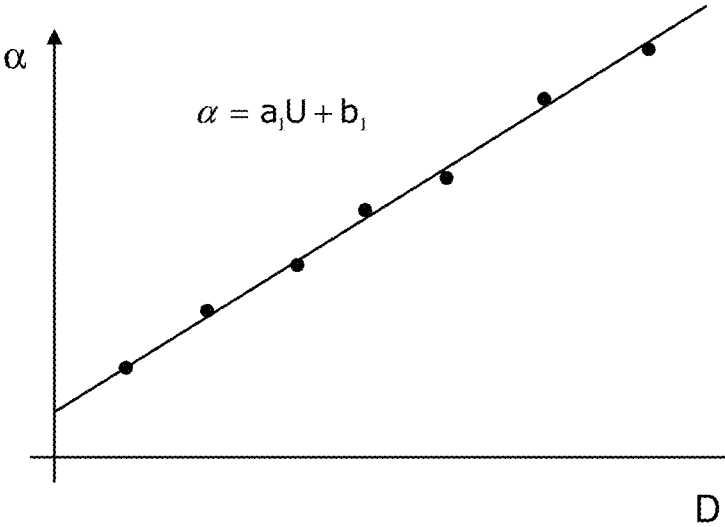
Fig. 11B
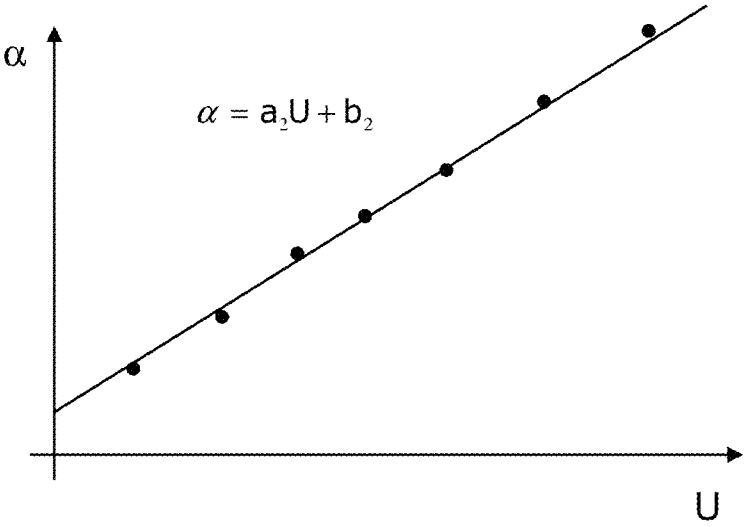
Fig. 11C

POSITION DETECTION DEVICE AND METHOD FOR DETECTING THE POSITION OF A BUCKET OF AN EXCAVATOR

CROSS REFERENCE TO RELATED APPLICATIONS

This application is a continuation under 35 U.S.C. 111 of International Patent Application No. PCT/DK2020/050231, filed Aug. 11, 2020, which claims the benefit of and priority to Danish Application No. PA 2019 00955, filed Aug. 13, 2019, each of which is hereby incorporated by reference in its entirety.

FIELD OF INVENTION

The present invention relates to a device and a method for detecting the position of a bucket of an excavator. The invention more particularly relates to a device and a method for detecting the position of one or more structures of a bucket of an excavator having a cab and a bucket that is rotatably mounted to a stick being rotatably attached to a boom of the excavator, wherein said excavator comprises a boom that is rotatably attached to the cab by means of a mounting structure. The boom is arranged to rotate with respect to a vertical axis and with respect to a horizontal axis.

BACKGROUND

Excavators are digging machines, typically mounted on tracks or wheels. A typical excavator has a bucket mounted to the end of a two-member linkage or a three-member linkage. When the excavator has a bucket mounted to the end of a two-member linkage, one of the links, called a boom, is pivotally mounted to a mounting structure of the excavator and extends outward in an upward direction. The other link, is typically referred to as a stick and is pivotally mounted at one end to the outer end of the boom and extends downward from the boom pivot.

When the excavator has a bucket mounted to the end of a three-member linkage, a first boom is pivotally mounted to a mounting structure of the excavator and extends outward in an upward direction. A second boom is rotatably mounted to the distal end of the first boom and extends between the first boom and a stick being pivotally mounted at the distal end of the second boom.

In some constructions, the stick is provided as a telescopic arm.

The bucket is rotatably attached to the outer end of the stick. A typical excavator comprises three or four hydraulic cylinders arranged to independently move the boom(s), the stick, and the bucket under the control of an operator or a machine control system. An excavator is typically provided with a hydraulic drive arranged and configured to rotate the machine base relative to the track to permit repositioning the bucket for operations like dumping.

It requires a skilled operator to operate an excavator efficiently. Since each of the couplings between the machine base, boom(s), stick, and bucket are pivots, extending or retracting any single hydraulic cylinder will cause the digging edge of the bucket to move in an arc.

One problem associated with the operation of an excavator is how to indicate to the operator the position of the bucket. For the large-type excavators (typically above 12-15,000 kg) various devices for determining the position of the bucket have been developed. One known way to determine the position of the bucket is to utilize angular sensors (inertial measurement units (IMU)) to detect the relative angles between the machine base, boom, stick, and bucket. Hereafter, it is possible to calculate the position of the bucket, using principles of geometry, given the measured angles and the lengths of the links. In practice, an IMU is configured to measure the angle of a segment relative to the gravity vector.

The prior art position detection devices are, however, not suitable for being used to detect the position of the bucket of small-sized excavators (typically below 12-15,000 kg). A small-sized excavator typically comprises a cab and a bucket rotatably mounted to a stick being rotatably attached to a boom, possibly rotatably attached to a second boom, rotatably attached to the cab by means of a mounting structure rotatably attached to the cab by means of a shaft having a longitudinal axis (perpendicular to the axis extending from the rear side to the front side) extending basically vertically during normal use of the excavator. The mounting structure is arranged and configured to allow the boom to be rotated with respect to the longitudinal axis of the shaft. It is usually not possible to apply an IMU to measure the rotation of the boom with respect to the longitudinal axis of the shaft. Accordingly, the prior art position detection devices do not take into consideration that the boom can be rotated with respect to the longitudinal axis of the shaft. Accordingly, the prior art position detection devices fail to determine the position of the bucket in an accurate manner when it comes to small-sized excavators. Thus, use of a prior art position detection device will result in inaccurate bucket position determination.

Thus, there is a need for a device and a method which enables a more accurate determination of the position of the bucket in small-sized excavators.

BRIEF DESCRIPTION

A position detection device according to the invention is a position detection device for detecting the position of a bucket of an excavator having a cab and an arm comprising one or more booms. The excavator comprises a first boom rotatably attached to the cab by a shaft having a longitudinal axis extending basically vertically during normal use of the excavator. The bucket is rotatably mounted to a stick, the stick rotatably attached to the most distal boom. The cab has a longitudinal axis (an axis extending from the rear side to the front side of the cab) and a lateral axis (this axis extends horizontally and is lateral with respect to the longitudinal axis) extending perpendicular thereto. The mounting structure is arranged and configured to allow the first boom and thus the arm to be rotated about the longitudinal axis of the shaft. The position detection device comprises one or more 3-D positioning devices such as antennas arranged and configured to receive satellite signals from one or more satellites. The position detection device comprises a sensor assembly configured to measure a quantity related to the rotation of the first boom about the longitudinal axis of the shaft in order to detect the angular position of the first boom with respect to rotation about the longitudinal axis of the shaft on the basis of the measured quantity. The position detection device comprises a control unit configured to calibrate the sensor assembly.

Hereby, it is possible to provide a position detection device that enables a more accurate determination of the position of the bucket in small-sized excavators. The position detection device takes into account the angular position of the first boom with respect to rotation about the longitudinal axis of the shaft.

By the term "position" of the bucket is meant the coordinate of one or more structures of the bucket and/or the orientation of the bucket and/or the relative position (distance to a predefined position or line or plane such as a horizontal plane) and/or the relative orientation (e.g. angle with respect to a predefined direction such as vertical or horizontal).

By the term "during normal use" is meant "when the excavator is placed on a horizontal surface".

By the term "bucket" is meant any excavator attachment (any tool suitable for being mounted on the distal end of the stick). Accordingly, the bucket may be an excavator bucket, an excavator-mounted drilling attachment such as an auger, a brush mower, a concrete breaker, a compactor wheel, a crusher bucket, a drum cutter, a forestry mulcher, a hydraulic thumb or a plate compactor.

The proximal end of the first boom is rotatably mounted such that the first boom can rotate with respect to a vertical axis and to a horizontal axis. In one embodiment, the antennas are Global Navigation Satellite System (GNSS) antennas. In one embodiment, the antennas are replaced by other 3-D positioning devices. In one embodiment, the 3-D position devices are laser sensors. In one embodiment, the 3-D position devices are optical sensors such as cameras.

A position detection device according to the invention is a position detection device for detecting the position of a bucket of an excavator having a cab. The position detection device is also configured to detect the orientation of the bucket. It is important to emphasize that the bucket can be rotatably attached to the stick in numerous ways allowing the bucket to rotate relative to the stick with respect to one or more axes of rotation.

The bucket is rotatably mounted to a stick, said stick being rotatably attached to the most distal boom. The arm may comprise one, two or more booms. The stick is attached to the most distal boom. The most proximal boom, however, is rotatably attached to the cab by means of a mounting structure that is rotatably attached to the cab by a shaft. The shaft may be a one-piece body. However, it may also comprise several separate segments.

In one embodiment, the stick is formed as a telescopic arm capable of changing its length. In another embodiment, the stick has a fixed length.

The shaft has a longitudinal axis extending basically vertically during normal use (when the excavator is arranged on a horizontal surface) of the excavator. The cab has a longitudinal axis (extending from its rear end to its front end) and a lateral axis extending perpendicular thereto.

The mounting structure is arranged and configured to allow the boom to be rotated with respect to the longitudinal axis of the shaft.

The position detection device comprises at least one antenna arranged and configured to receive satellite signals from one or more satellites. The antenna may be referred to as a Global Navigation Satellite System, GNSS receiver. In an embodiment, the position detection device comprises two antennas arranged and configured to receive satellite signals from one or more satellites. The position detection device comprises a unit configured to determine a position on the basis of the satellite signals.

The position detection device comprises a sensor assembly configured to detect the angular position of the first boom with respect to rotation about the longitudinal axis of the shaft. In an embodiment, the position detection device is configured to detect the angular position of the first boom with respect to rotation about the longitudinal axis of the shaft on a continuous basis.

In an embodiment, the angular position of the first boom with respect to rotation about the longitudinal axis of the shaft is defined as the angle between any predefined direction and the projection of the longitudinal axis of (at least a portion, e.g. the proximal portion of) the first boom in the plane spanned by the lateral axis of the cab and the longitudinal axis of the cab. This plane extends perpendicular to the longitudinal axis of the shaft.

In an embodiment, the angular position of the first boom with respect to rotation about the longitudinal axis of the shaft is defined as the angle between the longitudinal axis of the cab and the projection of the longitudinal axis of the proximal portion of the first boom in the plane spanned by the lateral axis of the cab and the longitudinal axis of the cab.

In an embodiment, the quantity related to the rotation of the first boom about the longitudinal axis of the shaft is a distance between the cab and the mounting structure.

In an embodiment, the quantity related to the rotation of the first boom about the longitudinal axis of the shaft is an angular measurement.

In an embodiment, the sensor assembly is configured to measure a distance between the cab and the mounting structure. Hereby, it is possible to provide a reliable, simple and efficient way of detecting the angular position of the first boom with respect to rotation about the longitudinal axis of the shaft.

In an embodiment, the sensor assembly is configured to measure the distance between one predefined position of a first group of elements and a predefined position of a second group of elements, wherein the first group of elements comprises the cab, wherein the second group of elements comprises the first boom and the mounting structure.

The measurement of the distance may be carried out using any suitable distance detection unit including laser distance measurement sensors and ultrasonic distance sensors and wire sensors.

In an embodiment, the control unit is configured to calibrate the sensor assembly by measuring the angular position of the first boom with respect to rotation about the longitudinal axis of the shaft using a predefined protocol and for detecting the output from the sensor assembly for a plurality of configurations having different angular positions.

The predefined protocol may be any of the protocols defined in the detailed description and referred to as:

A first calibration procedure;

A second calibration procedure;

A third calibration procedure;

A fourth calibration procedure or

A fifth calibration procedure;

In an embodiment, the predefined protocol applies one or more of the following measurements to detect the angular position:

a) the orientation and position of the cab measured using sensors available on the cab (or a structure fixed to the cab);

b) the orientation of the boom;

c) the position of the longitudinal axis of the shaft; and/or d) the position of a fixed point on the arm or the bucket.

The position of the longitudinal axis of the shaft corresponds to the axis of rotation.

A position detection device and method according to the invention may apply one or more sensors that may include one or more IMU. By "IMU" is meant an electronic device configured to measure and report a specific force and/or angular rate and/or the orientation of a body using a combination of accelerometers, gyroscopes, and sometimes magnetometers and pressure sensors. Using an IMU it is possible for a satellite-based radio-navigation system receiver to work when satellite-signals are unavailable. In the following, GNSS (Global Navigation Satellite System) antennas are meant when referring to antennas receiving satellite signals.

In an embodiment, the predefined protocol applies the orientation of the cab measured using sensors available on the cab (or a structure fixed to the cab) to detect the angular position.

In an embodiment, the predefined protocol applies the orientation of the boom to detect the angular position.

In an embodiment, the predefined protocol applies the position of the shaft to detect the angular position.

In an embodiment, the predefined protocol applies the position of a fixed point on the bucket to detect the angular position.

In an embodiment, the predefined protocol applies the position of a fixed point on the bucket to detect the angular position.

In an embodiment, the sensor assembly is configured to measure the radial displacement of the rotation cylinder. Hereby, this radial displacement can be used to determine the rotation angle.

In an embodiment, the sensor assembly is configured to measure the distance between a fixed position on the cab or on a structure attached thereto and a fixed position on the mounting structure or a structure attached thereto. Hereby, it is possible to detect the angular position of the first boom with respect to rotation about the longitudinal axis of the shaft in a simple way by applying standard measurement components.

In an embodiment, the angular position of the first boom with respect to rotation about the longitudinal axis of the shaft is detected by measuring the length of a rotation cylinder extending between the cab and the mounting structure.

In an embodiment, the sensor assembly comprises a wire sensor. Hereby, it is possible to provide a simple, robust and reliably way of determining the angular position of the boom with respect to rotation about the longitudinal axis of the shaft. By the term wire (for the wire sensor) is meant any suitable structure having basically the same mechanical properties as a wire including a string, a cord or a line.

In an embodiment, the position detection device comprises one or more inclination sensors or one or more IMU connected to the cab (or a structure attached thereto) and/or on the boom and/or on the stick and/or on the bucket. Hereby, the inclination of one of the components can be taken into account. Accordingly, the determination of the position and/or the orientation of the bucket will be more accurate. The inclination sensors may be mounted on any link or joint of the structure that is rotatably mounted with respect to the shaft.

A position detection device comprises a control unit configured to calibrate the sensor assembly using a predefined list of wire lengths at a number of predefined rotational positions of the boom. Hereby, it is possible to apply a simple sensor assembly to detect the angular position of the first boom with respect to rotation about the longitudinal axis of the shaft on the basis of the distance. The sensor assembly is configured to measure a quantity that is related to the rotation of the first boom about the longitudinal axis of the shaft and to determine the angular position of the first boom with respect to rotation about the longitudinal axis of the shaft on the basis of the measured quantity. This means that a simple sensor can be used to perform the required angular measurements.

In an embodiment, the quantity is a distance between the cab (or a structure fixed to the cab) and the mounting structure.

In an embodiment, the quantity is a rotation measured by one or more rotational sensors.

In an embodiment, the quantity is a vibration signal measured by one or more vibration sensors.

The calibration may be carried out using the GNSS receivers of the excavator to determine the orientation of the cab. It is possible to provide a calibration line extending in a predefined direction (e.g. parallel to the longitudinal axis of the cab) by means of a wire, a string, a rope or a straight beam. Hereafter the cab can be rotated with respect to its vertical axis of rotation while the first boom remains parallel with the calibration line. By noting corresponding values of the rotational angle and the wire length, it is possible to fill out a table like the one shown and explained with reference to FIG. 5.

In an embodiment, a position detection device comprises two spaced apart mounting brackets and a wire sheath extending between two sheath mounts arranged at each end of the wire sheath, wherein the wire is slidably arranged in said wire sheath and extends in extension thereof. This solution is easy to implement and allows the wire to be mounted in various positions. Accordingly, the position detection device can be mounted on excavators having different shapes and structures onto which the wire sensor must be mounted.

In an embodiment, the wire protrudes out of each end of the wire sheath.

In an embodiment, a position detection device comprises a display unit configured to display the rotation of the mounting structure with respect to the longitudinal axis of the shaft. Hereby, the operator is capable of controlling the excavator in a more efficient manner.

It may be an advantage that the position detection device comprises a control unit connected to the display, wherein the control unit is configured to receive the detected angular position of the first boom with respect to rotation about the longitudinal axis of the shaft on a continuous basis.

In an embodiment, a position detection device comprises a display unit configured to display the position and/or orientation of the bucket. Hereby, the operator is capable of controlling the excavator in a more efficient manner.

A method according to the invention is a method for determining the position of a bucket of an excavator having a cab and an arm comprising one or more booms, wherein the excavator comprises a first boom rotatably attached to the cab by a mounting structure that is rotatably attached to the cab by a shaft having a longitudinal axis extending basically vertically during normal use of the excavator. The bucket is rotatably mounted to a stick that is rotatably mounted to the most distal boom. The cab has a longitudinal axis and a lateral axis extending perpendicular thereto, wherein the mounting structure is arranged and configured to allow the first boom and thus the arm to be rotated about the longitudinal axis of the shaft. A position detection device comprises at least one 3-D positioning device such as an antenna arranged and configured to receive satellite signals from one or more satellites. The method comprises the step of detecting the angular position of the first boom with respect to rotation about the longitudinal axis of the shaft, calibrating the sensor assembly by measuring the angular position of the first boom with respect to rotation about the longitudinal axis of the shaft using a predefined protocol, and detecting the output from the sensor assembly for a plurality of configurations of the excavator corresponding to different angular positions.

Hereby, it is possible to provide a more accurate determination of the position and/or orientation of the bucket than methods of the prior art.

By the term "during normal use" is meant "when the excavator is placed on a horizontal surface".

In an embodiment, a position detection device comprises a control unit configured to calibrate the sensor assembly.

In an embodiment, the angular position is determined by measuring a distance between the cab and the mounting structure. Hereby, it is possible to determine the angular position in an easy and reliable manner. It has to be emphasized that one has to measure the distance between two specific predefined positions on the cab (or a structure fixed to the cab) as well as two predefined positions on the mounting structure (or a structure fixed to the mounting structure), respectively.

In an embodiment, the distance between the cab and the mounting structure is measured using a wire sensor. Hereby, it is possible to provide a simple robust and reliable way of detecting the angular position.

In an embodiment, the predefined protocol applies the orientation of the cab measured using sensors available on the cab (or a structure fixed to the cab) to detect the angular position.

In an embodiment, the predefined protocol applies the orientation and position of the cab measured using sensors available on the cab (or a structure fixed to the cab) to detect the angular position.

In an embodiment, the predefined protocol applies the orientation of the boom to detect the angular position.

In an embodiment, the predefined protocol applies the position of the longitudinal axis of the shaft to detect the angular position.

In an embodiment, the predefined protocol applies the position of a fixed point on the bucket to detect the angular position.

In an embodiment, the step of calibrating the sensor assembly is carried out using a calibration procedure, in which the position of the cab is measured using a number of sensors available on the cab or a structure rigidly fixed to the cab, wherein the excavator comprises an arm defined as the structures that are being moved when rotating the mounting structure about the shaft. The calibration procedure comprises the step of placing the excavator in a position, in which the position of the shaft and a fixed point on the arm are known, wherein the calibration procedure moreover comprises the step of rotating the arm with respect to the shaft into a plurality of different angular positions relative to the lateral axis of the cab, wherein for each of these angular positions (into which the arm is positioned) the angle between the arm and the lateral axis of the cab is determined.

In an embodiment, the excavator comprises an arm defined as the structures that are being moved when rotating the mounting structure about the shaft. The step of calibrating the sensor assembly is carried out using a calibration procedure, in which the position of the cab is to be measured using sensors available on the cab or a structure rigidly fixed to the cab. The calibration procedure comprises the steps of arranging the excavator in a position, in which the position of the shaft is known, measuring the absolute position of a point on the arm, and rotating the arm with respect to the shaft into a plurality of different angular positions relative to the lateral axis of the cab, wherein for each of these angular positions (into which the arm is positioned) the angle between the arm and the lateral axis of the cab is determined.

In an embodiment, the excavator comprises an arm defined as the structures that are being moved when rotating the mounting structure about the shaft, wherein the step of calibrating the sensor assembly is carried out using a calibration procedure, in which the position of the cab is measured using sensors available on the cab or a structure rigidly fixed to the cab. The calibration procedure comprises the step of measuring a vector extending between a predefined point on the cab or a structure rigidly fixed to the cab to a fixed point on the arm, wherein the vector is measured by measuring the position of the points by means of 3-D positioning device such as a GNSS antenna arranged and configured to receive satellite signals from one or more satellites and hereby measure the position. The calibration procedure further comprises the step of comparing the orientation vector of the cab and the vector extending between the predefined point and the fixed point on the arm, wherein the latter step is carried out for a plurality of different angles between the arm and the lateral axis of the cab.

In an embodiment, the excavator comprises an arm defined as the structures that are being moved when rotating the mounting structure about the shaft, wherein the step of calibrating the sensor assembly is carried out using a calibration procedure, in which a number of gyroscopes placed on the arm are used to measure the relative angle of the arm from a predetermined point, wherein the measurement of the relative angle is carried out for a plurality of different angles between the arm and the lateral axis of the cab.

In an embodiment, the excavator comprises an arm defined as the structures that are being moved when rotating the mounting structure about the shaft, wherein the step of calibrating the sensor assembly is carried out using a calibration procedure, in which one or more accelerometers and/or gyroscopes and/or magnetometers placed on the arm are used together with one or more accelerometers and/or gyroscopes and/or magnetometers positioned on the cab or a structure rigidly fixed to the cab to measure the angle, wherein the measurement of the relative angle is carried out for a plurality of different angles between the arm and the lateral axis of the cab.

In an embodiment, a position detection device is a position detection device for detecting the position of a bucket of an excavator having a cab and one or more booms, wherein the excavator comprises a first boom being rotatably attached to the cab by means of a mounting structure that is rotatably attached to the cab by a shaft having a longitudinal axis extending basically vertically during normal use of the excavator. The bucket is rotatably mounted to a stick, said stick being rotatably attached to either the first boom or a second boom being rotatably attached to the first boom. The cab has a longitudinal axis and a lateral axis extending perpendicular thereto, wherein the mounting structure is arranged and configured to allow the first boom to be rotated with respect to the longitudinal axis of the shaft. The position detection device comprises one or more antennas arranged and configured to receive satellite signals from one or more satellites. The position detection device comprises a sensor assembly configured to detect the angular position of the first boom with respect to rotation about the longitudinal axis of the shaft, wherein the sensor assembly is configured to measure a distance between the cab and the mounting structure. The sensor assembly is configured to measure the distance between a fixed position on the cab or on a structure attached thereto and a fixed position on the mounting structure or a structure attached thereto. The sensor assembly comprises a wire sensor, wherein the position detection device comprises two spaced apart mounting brackets and a wire sheath extending between two sheath mounts arranged at each end of the wire sheath, wherein the wire is slidably arranged in said wire sheath and extends in extension thereof.

In an embodiment, a position detection device is a position detection device, in which the sensor assembly is configured to measure the distance between one predefined position of a first group of elements and a predefined position of a second group of elements, wherein the first group of elements comprises the cab, wherein the second group of elements comprises the first boom and the mounting structure.

In an embodiment, the position detection device is a position detection device, in which the position detection device comprises a display unit configured to display the rotation of the mounting structure with respect to the longitudinal axis of the shaft.

In an embodiment, a method disclosed herein is a method for determining the position of a bucket of an excavator having a cab and one or more booms, wherein the excavator comprises a first boom being rotatably attached to the cab by a mounting structure that is rotatably attached to the cab by a shaft having a longitudinal axis extending basically vertically during normal use of the excavator. The bucket is rotatably mounted to the stick that is rotatably mounted to either the first boom or a second boom rotatably attached to the first boom. The cab has a longitudinal axis and a lateral axis extending perpendicular thereto, wherein the mounting structure is arranged and configured to allow the first boom to be rotated with respect to the longitudinal axis of the shaft. The position detection device comprises at least one antenna arranged and configured to receive satellite signals from one or more satellites. The method comprises the step of detecting the angular position of the first boom with respect to rotation about the longitudinal axis of the shaft, wherein the angular position is determined by measuring a distance between the cab and the mounting structure, wherein the distance between the cab and the mounting structure is measured using a wire sensor. The wire sensor comprises two spaced apart mounting brackets and a wire sheath extending between two sheath mounts arranged at each end of the wire sheath, wherein the wire is slidably arranged in said wire sheath and extends in extension thereof.

It may be an advantage to have an excavator comprising a position detection device according to the invention.

BRIEF DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 11A shows a table with corresponding sensor data and angular data;

FIG. 11B shows a graph depicting the angle of the boom as a function of the distance measured by the sensor assembly of a position detection device according to the invention; and FIG. 11C shows a graph depicting the angle of the boom as a function of the electric output data from a sensor assembly of a position detection device according to the invention.

DETAILED DESCRIPTION

Figure 1A:
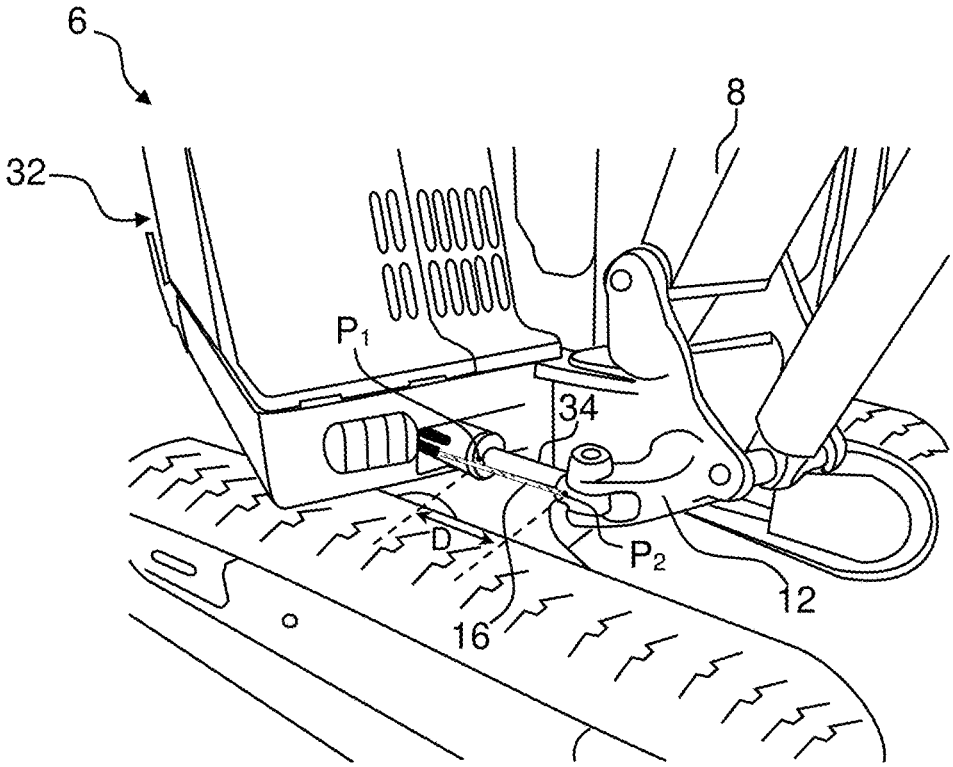
FIG. 1A shows an excavator provided with a position detection device according to the invention.

Referring now in detail to the drawings for the purpose of illustrating embodiments of the present invention, an excavator 6 provided with a position detection device according to the invention is illustrated in FIG. 1A. The excavator 6 comprises a cab 32 and a boom 8 that is attached to a mounting structure 12 rotatably attached to the cab 32 by a shaft having a longitudinal axis that extends vertically when the excavator 6 is arranged on a horizontal surface.

The excavator 6 comprises a rotation cylinder 34 extending between the mounting structure 12 and the cab 32. The rotation cylinder 34 is arranged to rotate the mounting structure 12 with respect to the longitudinal axis of the shaft upon being activated. Accordingly, by controlling the rotation cylinder 34, it is possible to rotate the mounting structure 12 and thus the boom 8 with respect to the longitudinal axis of the shaft.

Figure 3A:
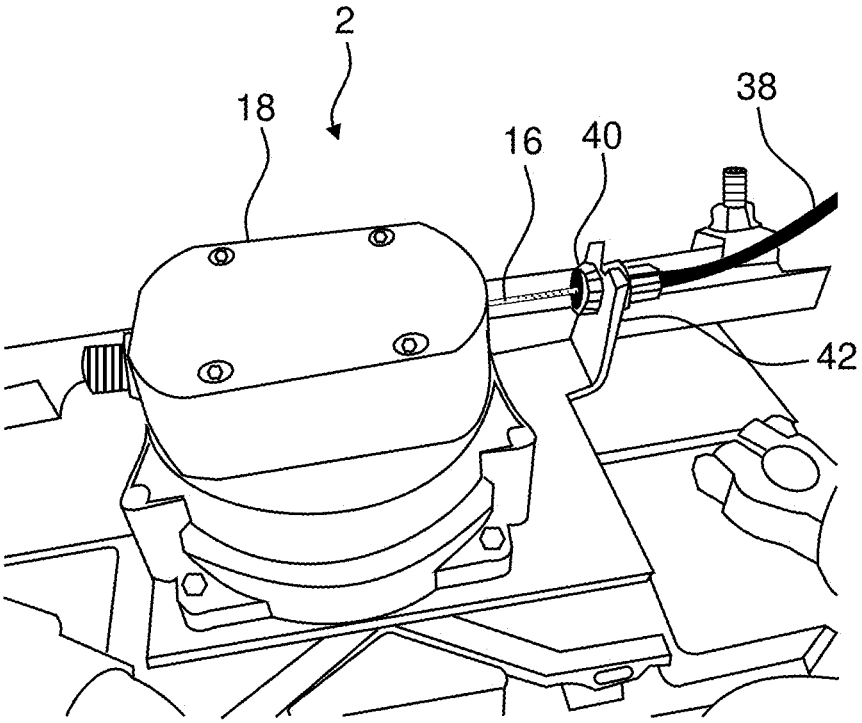
FIG. 3A shows a wire sensor of a position detection device according to the invention.
Figure 3B:
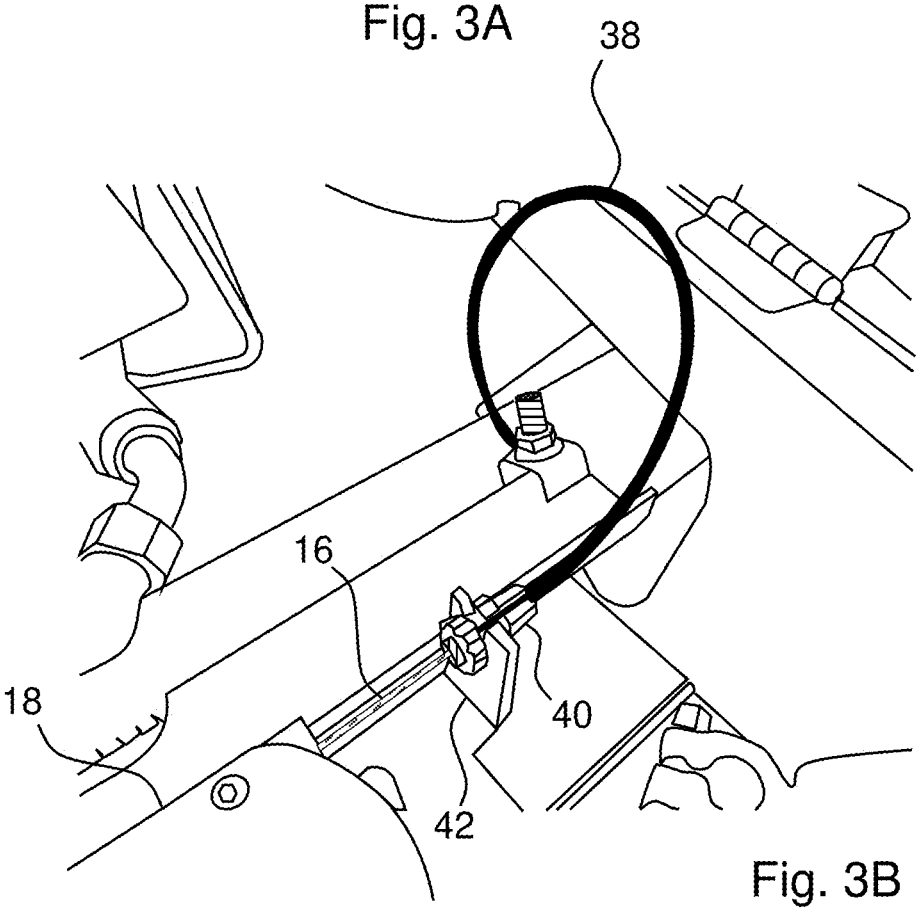
FIG. 3B shows another view of the wire sensor shown in FIG. 3A.

The excavator 6 comprises a position detection device having a wire sensor (see FIG. 3A and FIG. 3B). This wire sensor is arranged and configured to measure the length of a wire 16 extending between the wire sensor and a fixation point at the mounting structure 12. The wire sensor is configured to detect the length of the wire and thus the length change with respect to a reference point. Accordingly, the wire sensor can detect when the distance between two points $P_1$, $P_2$ is changed upon activation of the rotation cylinder 34. Thus, the wire sensor can detect the distance D between said points $P_1$, $P_2$.

Figure 1B:
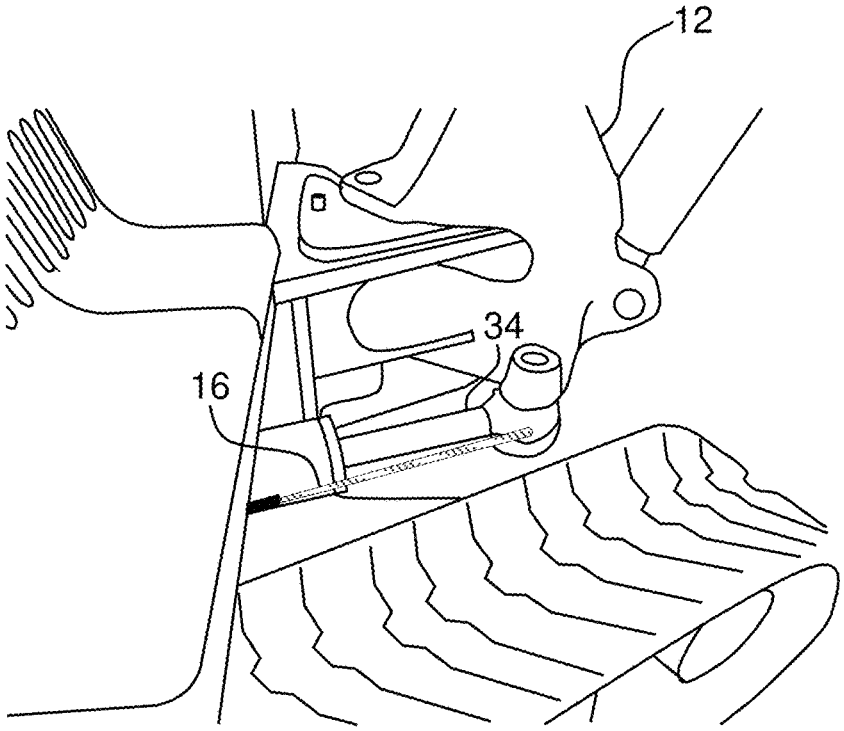
FIG. 1B shows a close-up view of the wire of a wire sensor of the position detection device shown in FIG. 1A.

FIG. 1B illustrates a close-up view of the wire 16 of a wire sensor of the position detection device shown in FIG. 1A. It can be seen that the wire 16 extends parallel to the length of the rotation cylinder 34. The rotation cylinder 34 is rotatably mounted to the mounting structure 12 so that the mounting structure 12 is allowed to rotate relative to the rotation cylinder 34 upon elongation of the rotation cylinder 34. The rotation cylinder 34 protrudes from the cab of the excavator in a basically horizontal direction.

Figure 2A:
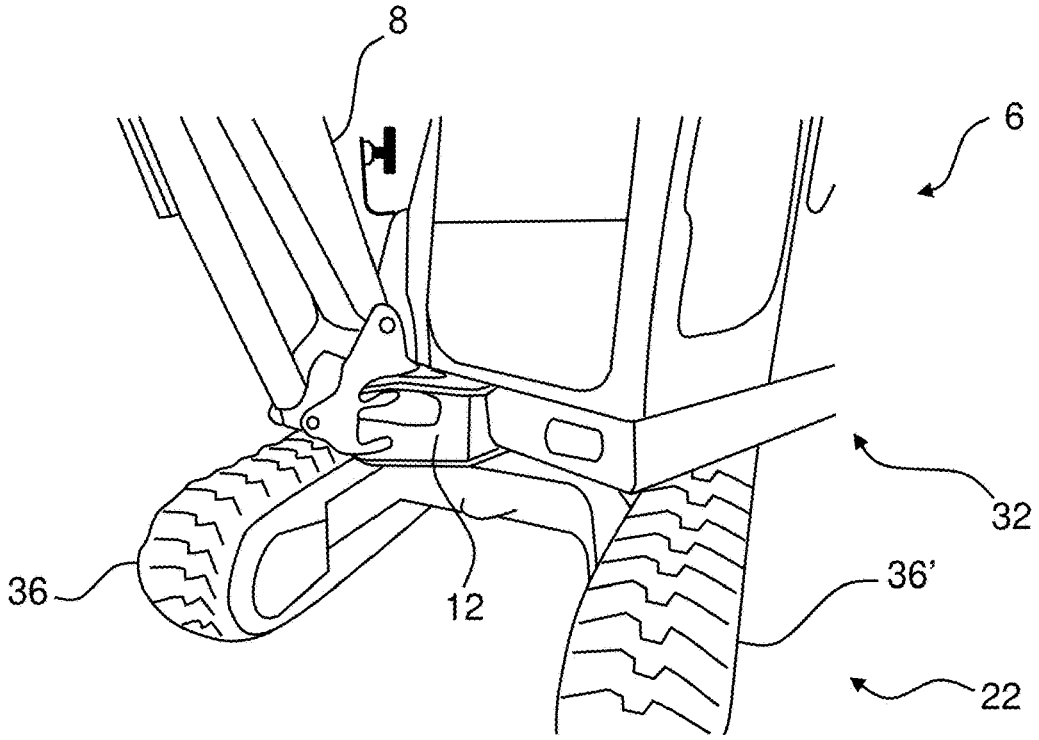
FIG. 2A shows a front view of an excavator provided with a position detection device according to the invention.

FIG. 2A illustrates a front view of an excavator 6 provided with a position detection device according to the invention. The excavator 6 comprises a driving assembly 22 comprising two parallel tracks 36, 36' provided at the base of the excavator 6. The excavator 6 comprises a cab 32 rotatably mounted on the base of the excavator 6. Accordingly, the cab 32 can rotate with respect to a vertical axis of rotation (when the excavator is placed on a horizontal surface).

The excavator 6 comprises a mounting structure 12 rotatably mounted to the front portion of the cab 32. The excavator 6 comprises a boom 8 rotatably attached to the mounting structure 12. The boom 8 is arranged to be rotated about a horizontal axis (when the excavator is placed on a horizontal surface). The boom 8 is also arranged to be rotated about a vertical axis (when the excavator is placed on a horizontal surface). The position detection device is configured to detect the angle of rotation with respect to the vertical axis.

Figure 2B:
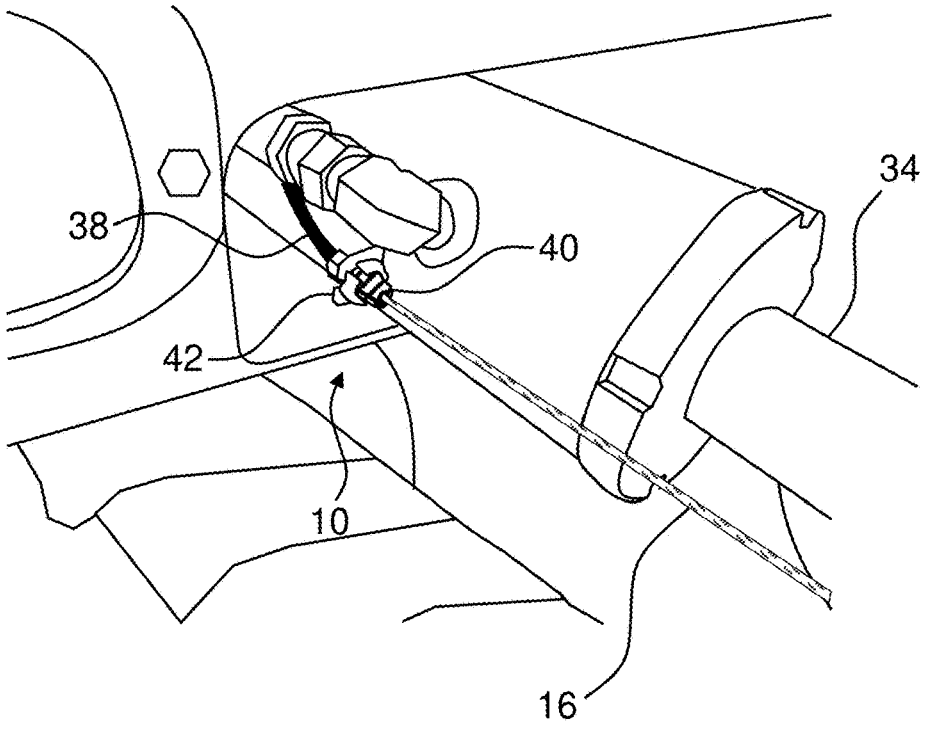
FIG. 2B shows another close-up view of the wire of a wire sensor of the position detection device shown in FIG. 1A.

FIG. 2B illustrates a close-up view of the wire 16 of a wire sensor of the position detection device shown in FIG. 1A. The position detection device comprises a sensor assembly 10 comprising a wire 16 arranged in a wire sheath 38 that is inserted into a sheath mount 40 being fixed to a mounting bracket 42. The sheath mount 40 is provided with outer threads for screwing it into an opening of the mounting bracket 42, wherein the opening is provided with corresponding threads. Accordingly, the sheath mount 40 can be displaced and hereby position adjusted along the length of the mounting bracket 42 by rotating the sheath mount 40.

FIG. 3A illustrates a wire sensor of a position detection device 2 according to the invention, whereas FIG. 3B illustrates another view of the wire sensor 18 shown in FIG. 3A. The position detection device 2 comprises a wire sensor 18 (sometimes referred to as a cable extension position sensor) arranged and configured to measure the length and/or length change of the wire 16 extending from the housing of the wire sensor 18. The wire 16 is slideably arranged in a wire sheath 38 that is inserted into a sheath mount 40 being fixed to a mounting bracket 42. In the same manner as illustrated in FIG. 2A, the sheath mount 40 is provided with outer threads for screwing it into an opening of the mounting bracket 42 and this opening is provided with corresponding threads. Therefore, the sheath mount 40 can be displaced and hereby position adjusted along the length of the mounting bracket 42 upon rotation of the sheath mount 40.

Figure 4A:
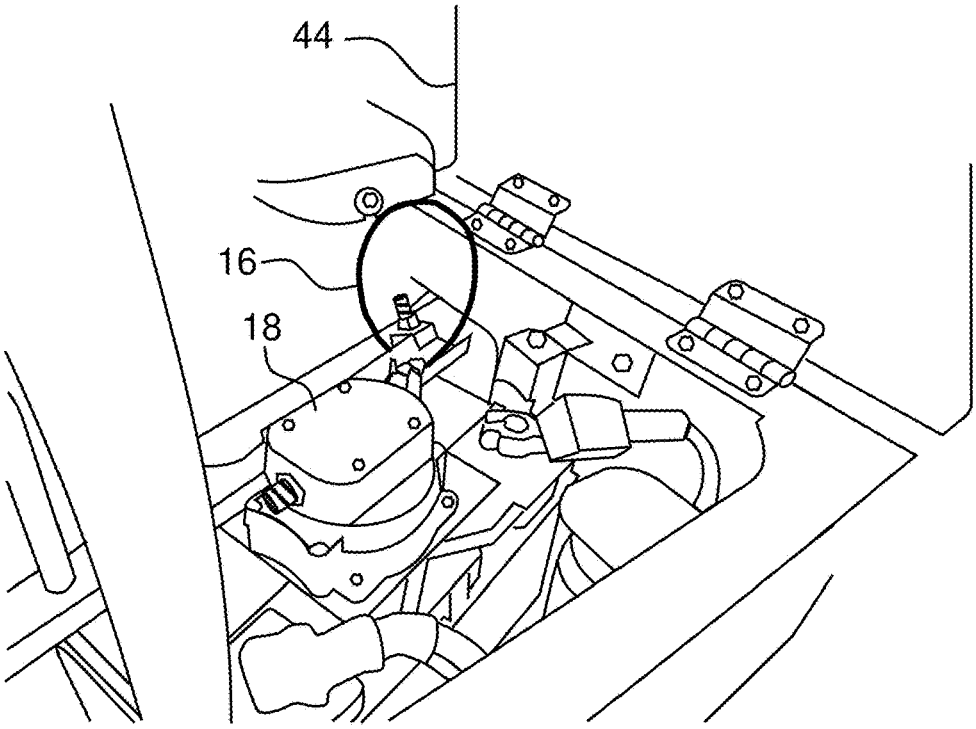
FIG. 4A shows a wire sensor of a position detection device according to the invention.

FIG. 4A illustrates the wire sensor 18 shown in FIG. 3A and FIG. 3B seen from a different view. It can be seen that the wire sensor 18 is arranged on the battery of the excavator and below a rotatably mounted cover 44 that is arranged in an upright position. Hereby, the wire sensor 18 is protected against rain. It is important to emphasize that the wire sensor 18 may be arranged elsewhere and that it may be an advantage not to arrange the wire sensor 18 on the top of the battery to allow free access to the battery.

Figure 4B:
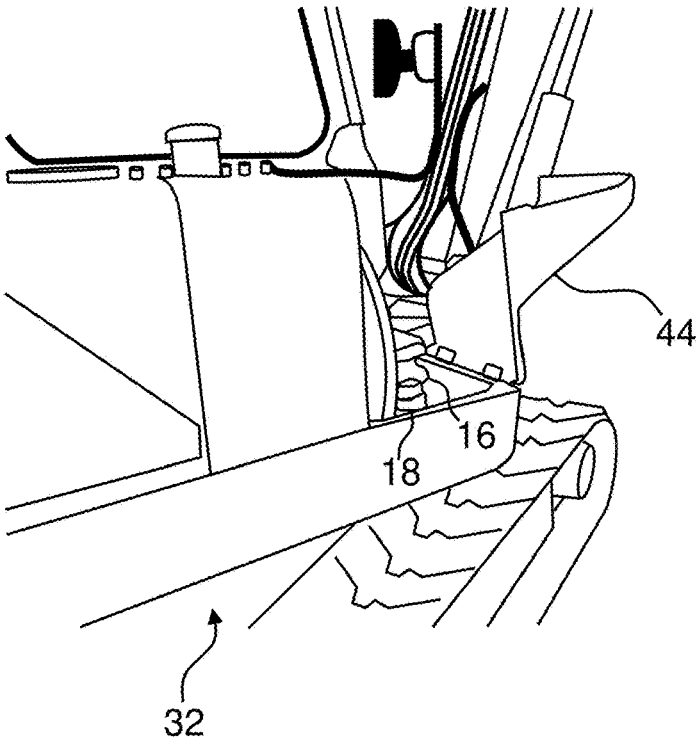
FIG. 4B shows an excavator provided with a position detection device according to the invention.

FIG. 4B illustrates an excavator 6 provided with a position detection device such as the one illustrated in FIG. 4A. The wire sensor 18 is arranged on the battery of the excavator and is rotatably attached to the cab 32 of the excavator 6. It can be seen that a wire 16 protrudes from the wire sensor 18.

Figure 5:
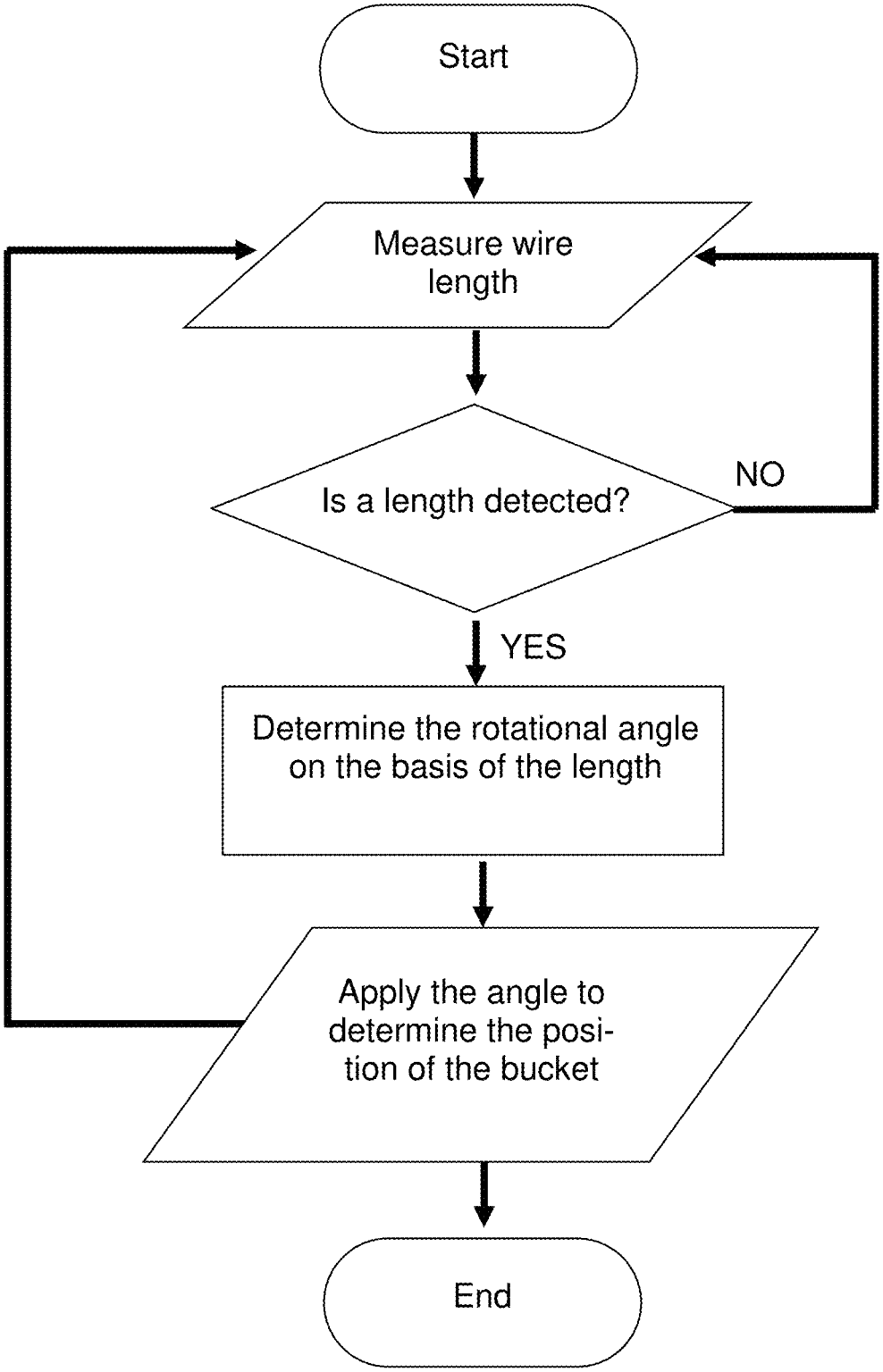
FIG. 5 is a flow chart showing how the rotational angle of the boom of an excavator can be determined.

FIG. 5 is a flow chart showing how the rotational angle of the boom of an excavator about the longitudinal axis of the shaft can be determined. Initially the length (or length change) of the wire is measured. It would be possible to measure another quantity not being a length e.g. using a rotation sensor. This may be done using a wire sensor shown in and as explained with reference to FIG. 3A, FIG. 3B, FIG. 4A and FIG. 4B. If the length of the wire can be measured, the rotational angle is determined on the basis thereof. In an embodiment, the rotational angle is determined using a table, in which corresponding length and angle values are given. Such table may comprise several table entries, each coupling a length range with a corresponding angle or an angle range with a corresponding length. The angle can be calculated using the following Table 1.

TABLE 1

| Length [mm] | 300 | 340 | 382 | 426 | 472 | 520 | 570 | 676 | 732 |
|---|---|---|---|---|---|---|---|---|---|
| Angle [°] | −8 | −6 | −4 | −2 | 0 | 2 | 4 | 6 | 8 |

Typically, the rotational angle is determined using a mathematical formula in combination with known angles and corresponding quantities.

If the length could not be measured, a new length measurement is conducted.

When the rotational angle, however, has been determined the rotational angle is used to determine (e.g. calculate) the position of the bucket. Such calculation will typically use position data determined using a satellite-based positioning system (a Global Navigation Satellite System, GNSS). The process illustrated in FIG. 5 can be carried on continuously.

Figure 6A:
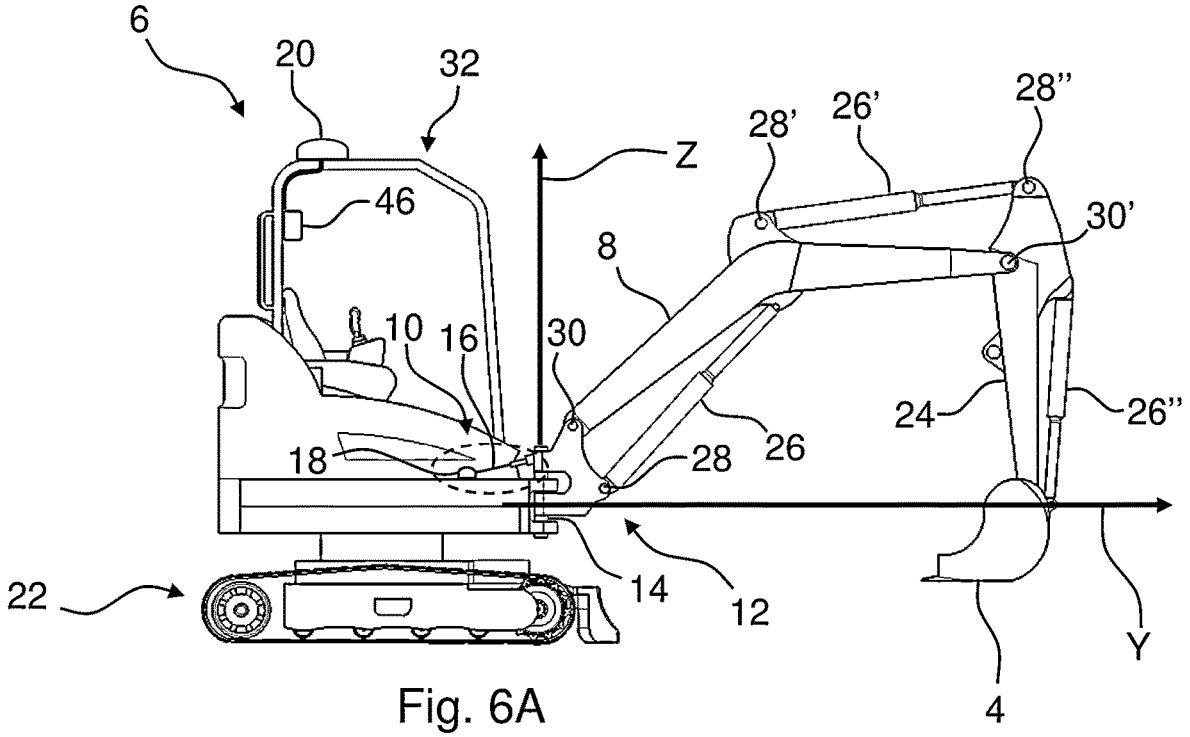
FIG. 6A shows a side view of an excavator provided with a position detection device according to the invention.

FIG. 6A illustrates a side view of an excavator 6 provided with a position detection device according to the invention. The excavator 6 comprises a cab 32 mounted on a base provided with a driving assembly 22. Accordingly, the excavator 6 is a tracked vehicle (a vehicle comprising tracks). In another embodiment, however, the excavator 6 may be wheeled. The excavator 6 comprises a mounting structure 12 rotatably mounted to the cab 32. The mounting structure 12 is mounted to a corresponding receiving structure of the cab 32 by a shaft 14. When the excavator 6 is arranged on a horizontal surface, as shown in FIG. 6A, the shaft 14 will be upright (extending vertically).

The excavator 6 comprises a boom 8 rotatably attached to the mounting structure 12 by a first boom joint 30. A first cylinder 26 is rotatably mounted to the mounting structure 12 by a first cylinder joint 28. The first boom joint 30 and the first cylinder joint 28 are spaced apart from each other. Accordingly, activation of the first cylinder 26 will cause the boom 8 to rotate with respect to the first boom joint 30.

A stick 24 is rotatably attached to the distal end of the boom 8 by a second boom joint 30'. A second cylinder 26' is rotatably attached to the boom 8 by a second cylinder joint 28' and to the stick 24 by a third cylinder joint 28".

Accordingly, activation of the second cylinder 26' will rotate the stick 24 with respect to the second boom joint 30 and thus the boom 8.

The excavator 6 comprises a bucket 4 rotatably attached to the distal end of the stick 24. A third cylinder 26" is rotatably attached to the stick 24 and to the bucket 4 in such a manner that activation of the third cylinder 26" will rotate the bucket 4 relative to the stick 24.

The mounting structure is arranged to be rotated with respect to the longitudinal axis Z of the shaft 14. This may be done by applying a cylinder (not shown) rotatably attached to the cab 32 and to the mounting structure 12.

The position detection device comprises a sensor assembly 10 comprising a wire 16 and a wire sensor 18 attached thereto. The wire sensor 18 is arranged to detect the length and/or the length change of the wire. The wire 16 extends between the wire sensor 18 and a point of attachment at the mounting structure 12. Accordingly, the wire sensor 18 can detect the distance between the mounting structure 12 and the wire sensor 18. This distance can be used to determine the rotational angle of the boom 8 with respect to the longitudinal axis Z of the shaft 14.

In another embodiment, the wire sensor 18 may be replaced with another sensor arranged and configured to determine the distance between the mounting structure 12 and a fixed point on the cab 32 or a structure fixed to the cab 32.

The angle can be calculated using a predefined table such as the one explained with reference to FIG. 5.

The excavator 6 comprises a cab-mounted GNSS receiver 20 that is connected to a control unit 46 of the position detection device. It is important to emphasize that the GNSS receiver 20 can be mounted elsewhere.

Figure 6B:
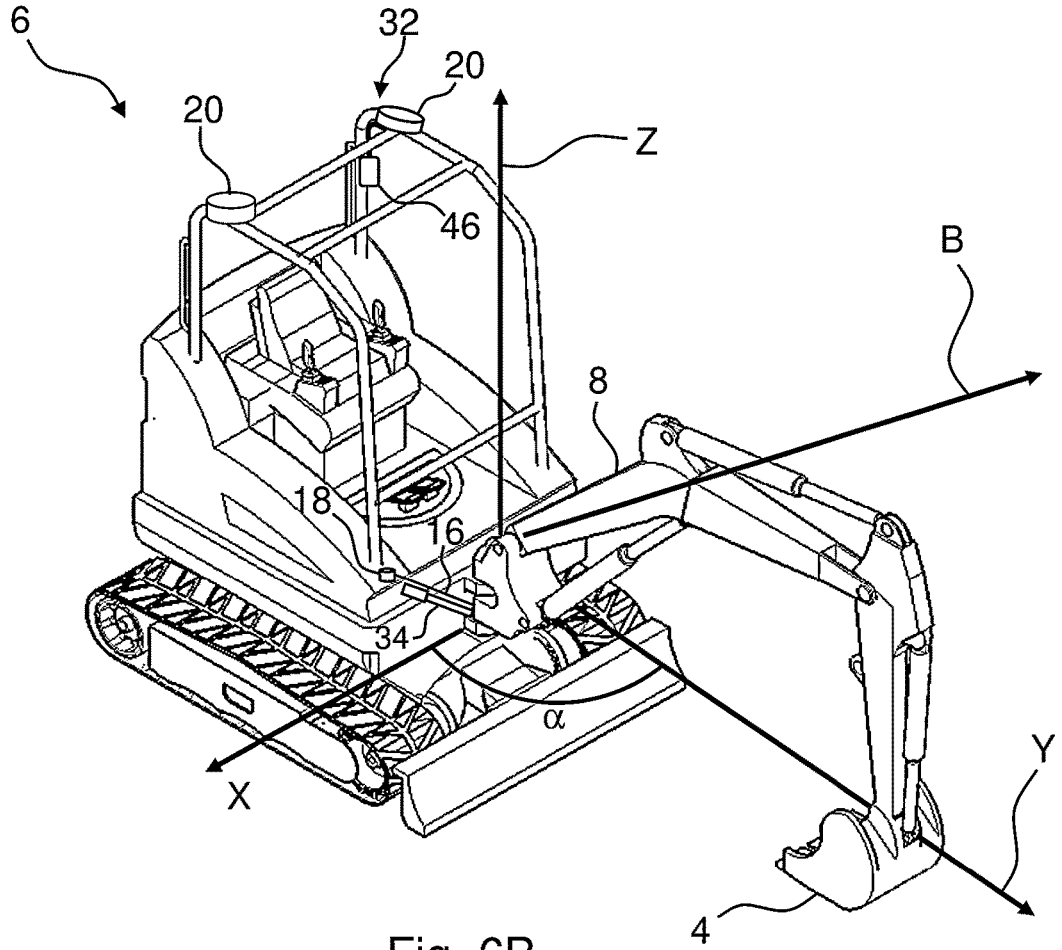
FIG. 6B shows a perspective view of the excavator shown in FIG. 6A.

FIG. 6B illustrates a perspective view of the excavator 6 shown in FIG. 6A. The excavator 6 comprises two GNSS receivers 20 mounted on the roof structure of the cab of the excavator 6. It can be seen that the mounting structure 12 can rotate about the longitudinal axis Z of the shaft. The longitudinal axis B of the proximal portion of the boom 8 is indicated. The lateral axis X and longitudinal axis Y of the cab 32 are also indicated. It can be seen that the rotational angle $\alpha$ of the boom 8 is approximately 90°. Accordingly, the boom 8 extends along the plane spanned by the longitudinal axis Y of the cab 32 and a vertical axis (an axis parallel to the longitudinal axis Z of the shaft. A rotation cylinder 34 extends between the cab 32 and the mounting structure 12. The rotation cylinder 34 is arranged and configured to rotate the mounting structure 12 with respect to the shaft by which the mounting structure 12 is rotatably attached to the cab 32.

The position detection device comprises a calculation unit configured to calculate the position of the bucket 4. In an embodiment, the calculation unit is configured to calculate the position of the bucket 4 on the basis of position data provided by the cab-mounted GNSS receivers 20, angular sensors arranged to measure the relative angles between the cab 32, boom 8, stick 24, and bucket 4 as well as the detected rotational angle $\alpha$. When these data are available, it is possible to calculate the position of the bucket 4, using principles of geometry.

In an embodiment, the position detection device comprises a display configured to visualize the bucket 4 relative to a predefined structure or position or line or height. Hereby, it is possible to provide a position detection device that is user-friendly and easy to use by the operator.

The position detection device comprises a wire sensor 18 having a wire 16 protruding from the housing of the wire sensor 18. The wire 16 extends between the housing of the wire sensor 18 and a fixation point at the mounting structure 12.

Figure 7A:
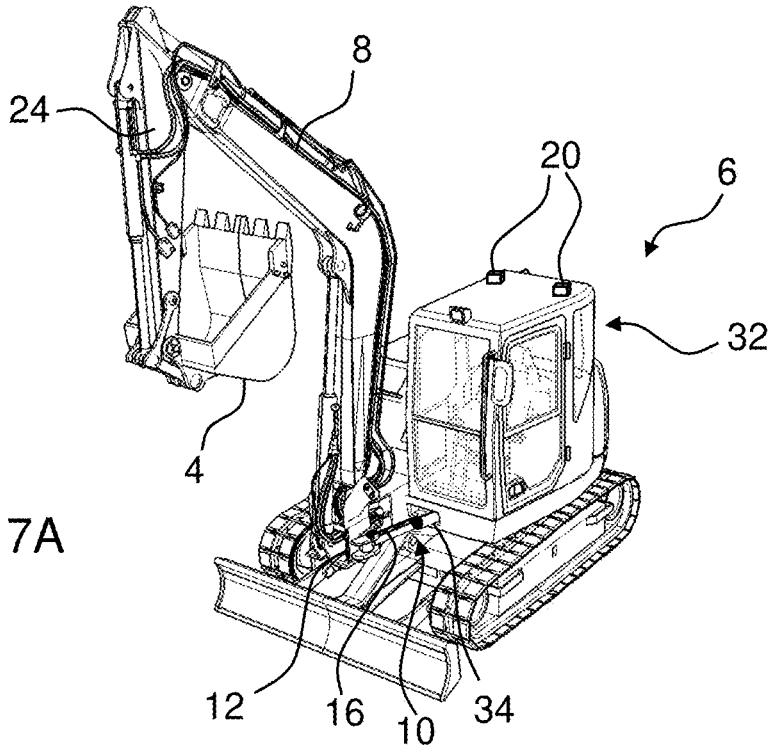
FIG. 7A shows a perspective view of an excavator provided with a position detection device according to the invention.

FIG. 7A illustrates a perspective view of an excavator 6 provided with a position detection device according to the invention. The excavator 6 comprises a cab 32 provided with two cab-mounted GNSS receivers 20. The excavator 6 comprises a boom 8 and a stick 24 rotatably mounted thereto. The excavator 6 comprises a mounting structure 12 by which the boom 8 is rotatably mounted to the cab 32 so that the boom 8 can rotate about a rotational axis extending basically vertically during normal use (when the excavator 6 is operated on a horizontal surface). The excavator 6 comprises a rotational cylinder 34 arranged to rotate the boom 8 with respect to said rotational axis. The excavator 6 comprises a bucket 4 rotatably attached to the distal end of the stick 24.

The position detection device comprises a sensor assembly 10 having a distance sensor arranged at the rotational cylinder 34 and detects the length of a wire 16 extending between a point of fixation on the mounting structure 12 and the distance sensor arranged on the rotational cylinder 34. The sensor assembly 10 detects the length of the wire 16 by means of the distance sensor. The length of the wire 16 is applied to detect the rotational angle of the boom 8 with respect to said rotational axis.

Figure 7B:
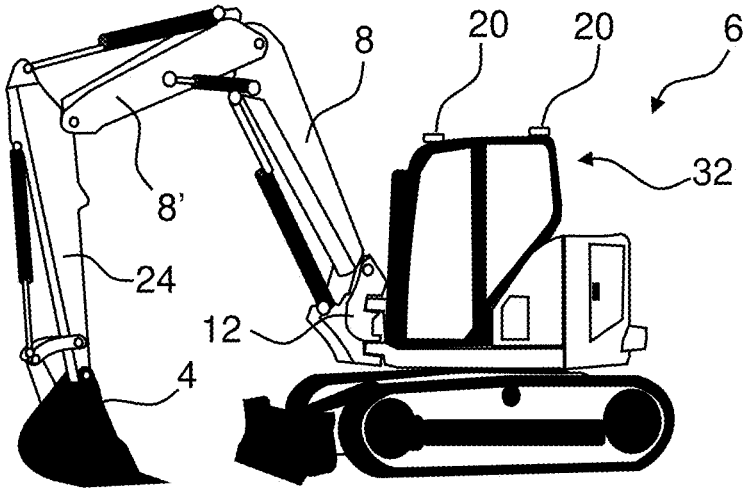
FIG. 7B shows a perspective view of another excavator provided with a position detection device according to the invention.

FIG. 7B illustrates a perspective view of another excavator 6 provided with a position detection device according to the invention. The excavator 6 comprises a cab 32 provided with two cab-mounted GNSS receivers 20. The excavator 6 comprises a first boom 8, a second boom 8' and a stick 24 rotatably mounted to the second boom 8'. The excavator 6 comprises a mounting structure 12 by which the first boom 8 is rotatably mounted to the cab 32 so that the first boom 8 can rotate about a rotational axis extending basically vertically during normal use (when the excavator 6 is operated on a horizontal surface). The excavator 6 comprises a rotational cylinder arranged to rotate the first boom 8 with respect to said rotational axis. The excavator 6 comprises a bucket 4 rotatably attached to the distal end of the stick 34.

Figure 8:
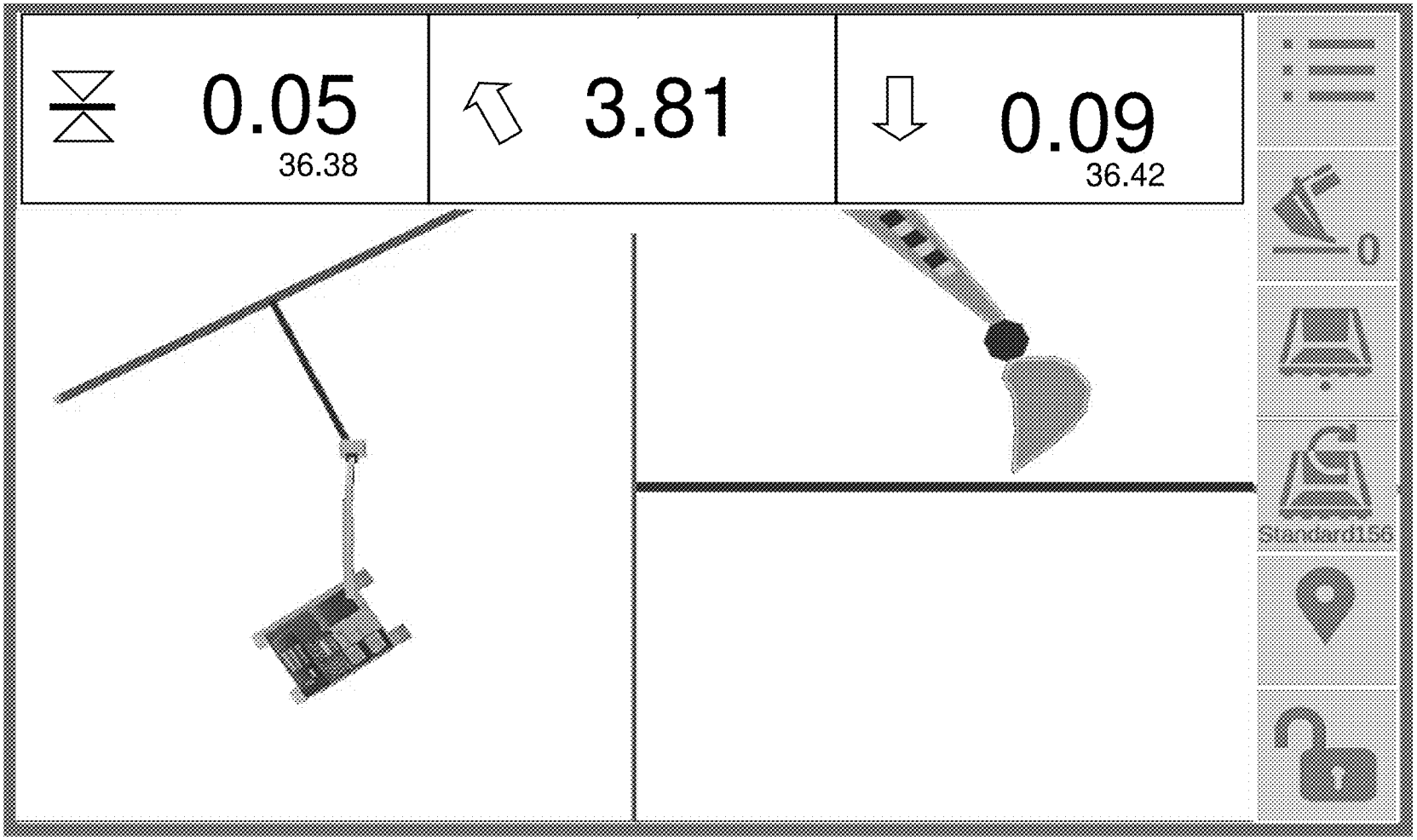
FIG. 8 shows a display of a position detection device according to the invention.

FIG. 8 illustrates a display of a position detection device according to the invention. A top view of the excavator is shown in the bottom left area. A line extending basically parallel to the longitudinal axis of the cab of the excavator is indicated and the distance from the bucket to this line is shown in the upper middle box. From this box, it can be seen that the distance from the bucket to the line is 3.81 m.

A side view of the bucket is shown in the middle right area of the display. It can be seen that the blade of the bucket is almost horizontally arranged and very close to the level of the ground (indicated with the line just below the bucket. However, in the upper left box it can be seen that the height of the left corner of the edge of the bucket is 0.05 m, whereas the height of the right corner of the edge of the bucket is 0.09 m. Accordingly, the bucket is not 100% horizontally arranged.

Figures 9A, 9B, 9C, 9D:
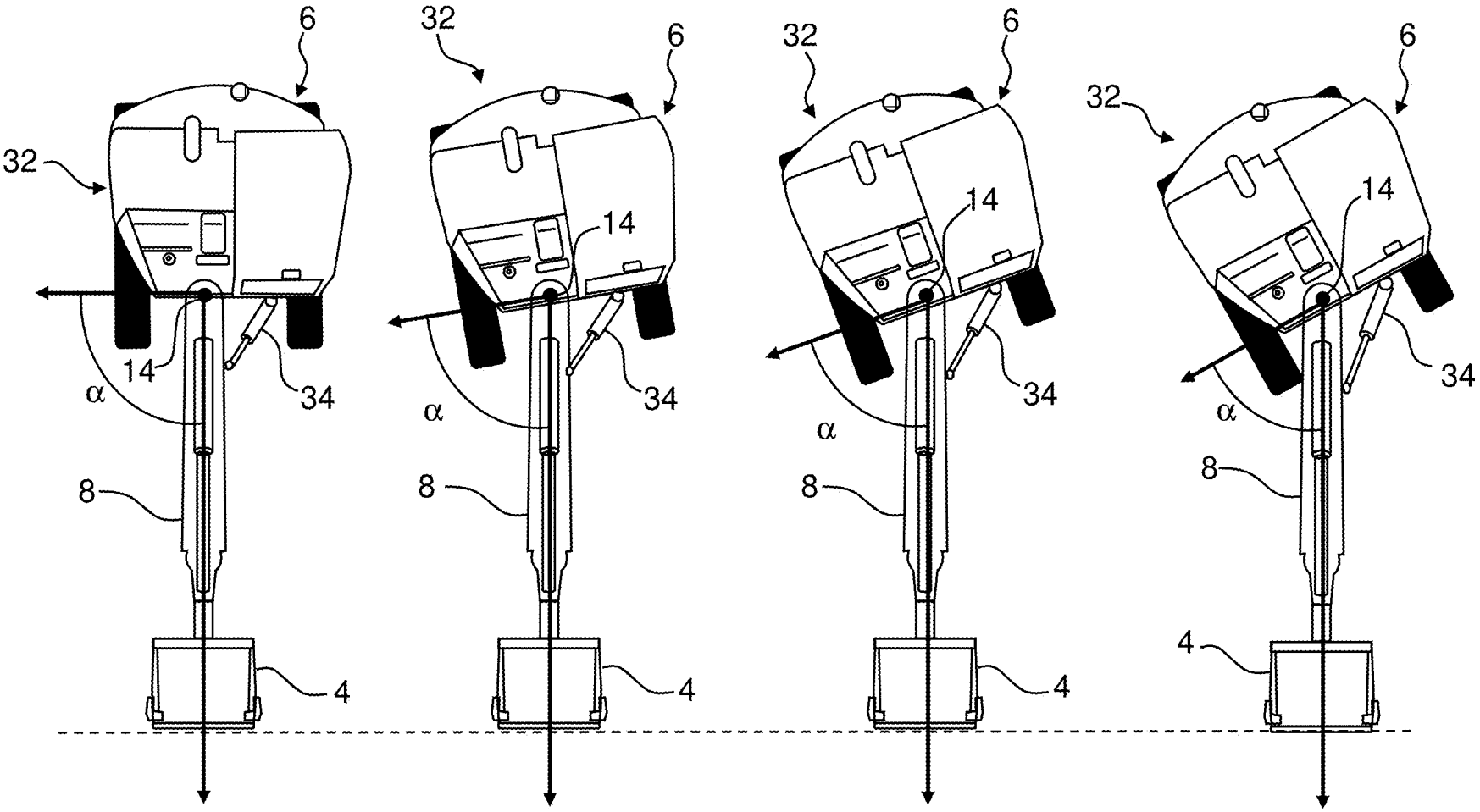
FIG. 9A shows a top view of an excavator comprising a position detection device according to the invention.
FIG. 9B shows a top view of the excavator shown in FIG. 9A in another configuration.
FIG. 9C shows a top view of the excavator shown in FIG. 9A and FIG. 9B in another configuration.
FIG. 9D shows a top view of the excavator shown in FIG. 9A, FIG. 9B and FIG. 9C in another configuration.

FIG. 9A, FIG. 9B, FIG. 9C and FIG. 9D illustrate top views of an excavator 6 comprising a position detection device according to the invention. The excavator 6 is arranged in different configurations during a calibration procedure, in which the boom 8 of the excavator 6 is fixed while angle $\alpha$ between the boom 8 and the lateral axis X of the cab 32 is changed (the cab 32 is rotated relative to the boom 8). In FIG. 9A, the angle $\alpha$ is approximately 90 degrees relative to the lateral axis X of the cab 32. In FIG. 9B, the angle $\alpha$ is about 80 degrees relative to the lateral axis X of the cab 32. In FIG. 9C, the angle $\alpha$ is approximately 70 degrees relative to the lateral axis X of the cab 32. In FIG. 9D, the angle α is about 60 degrees relative to the lateral axis X of the cab 32.

Figures 10A, 10B, 10C, 10D:
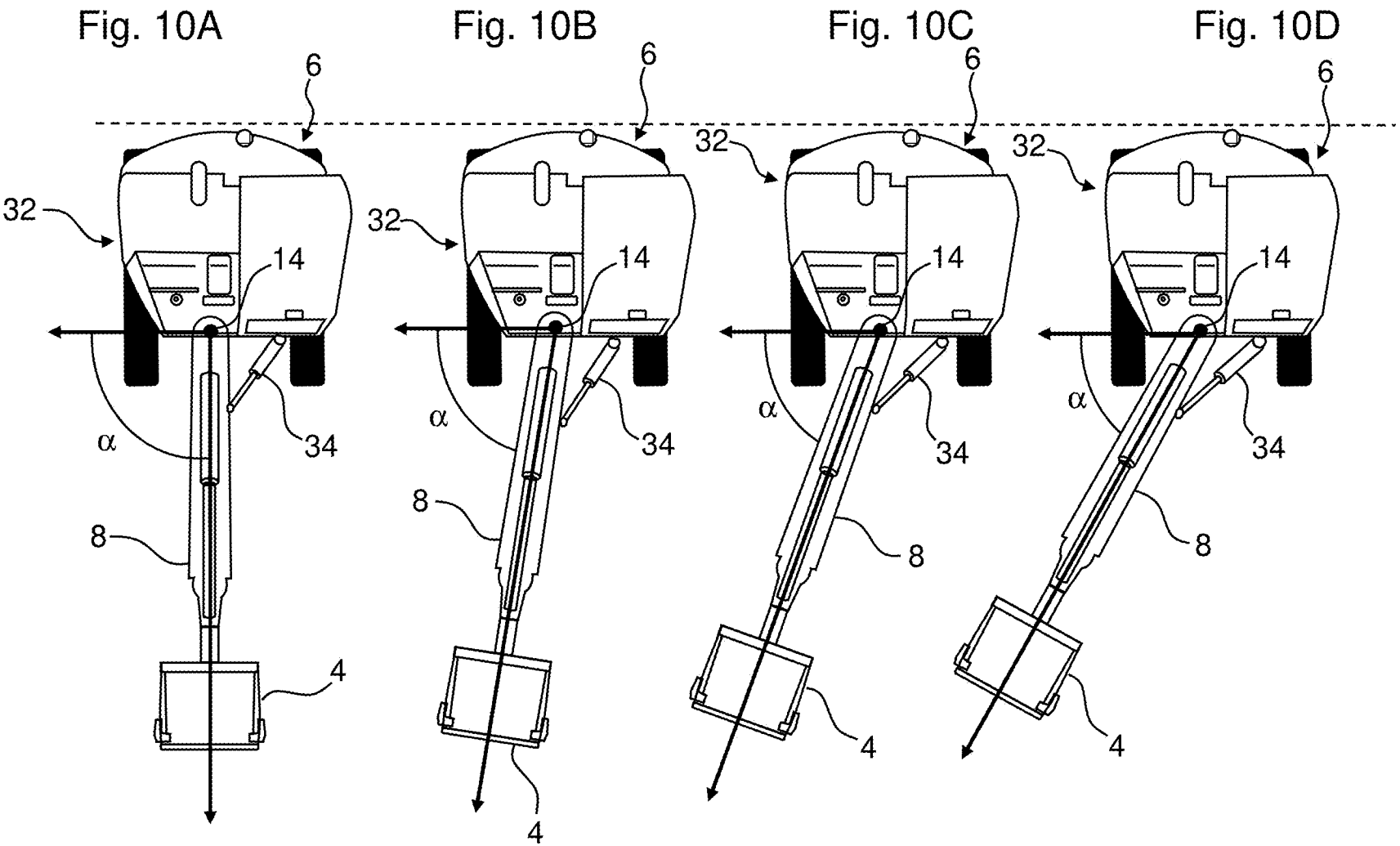
FIG. 10A shows a top view of an excavator comprising a position detection device according to the invention.
FIG. 10B shows a top view of the excavator shown in FIG. 10A in another configuration.
FIG. 10C shows a top view of the excavator shown in FIG. 10A and FIG. 10B in another configuration.
FIG. 10D shows a top view of the excavator shown in FIG. 10A, FIG. 10B and FIG. 10C in another configuration.

FIG. 10A, FIG. 10B, FIG. 10C and FIG. 10D illustrate top views of an excavator 6 comprising a position detection device according to the invention. The excavator 6 is arranged in different configurations during a calibration procedure, in which the cab 32 of the excavator 6 is fixed while angle α between the boom 8 and the lateral axis X of the cab 32 is changed (this is done using the rotation cylinder 34). In FIG. 10A, the angle α is approximately 90 degrees relative to the lateral axis X of the cab 32. In FIG. 10B, the angle α is about 80 degrees relative to the lateral axis X of the cab 32. In FIG. 10C, the angle α is approximately 70 degrees relative to the lateral axis X of the cab 32. In FIG. 10D, the angle α is about 60 degrees relative to the lateral axis X of the cab 32.

The position detection device comprises a control unit configured to calibrate the sensor assembly of the position detection device. Calibration of the sensor assembly can be done using various calibration procedures.

1. A First Calibration Procedure

Calibration of the sensor assembly can be done using a first calibration procedure, in which the orientation and position of the cab 32 is known during the entire calibration procedure. The position and orientation of the cab 32 can be measured using sensors available on the cab 32 or a structure fixed to the cab 32. The first calibration procedure comprises the step of placing the excavator 6 in a position, in which the position of the shaft 14 (to which the boom 8 is rotatably attached) and a fixed point on the stick 24, the bucket 4 or a boom 8 is known. This step can be accomplished by positioning the shaft 14 and the fixed point on the bucket 4 or the boom 8 in known positions on the ground.

The first calibration procedure moreover comprises the step of rotating the boom 8 into a plurality of angular positions relative to the lateral axis X of the cab 32. For each of these angular positions, it is possible to determine the angle α between the boom 8 and the lateral axis X of the cab 32. Calculation of the angle α between the boom 8 and the lateral axis X of the cab 32 can be done using simple geometric formulas. If the position of the shaft 14 is defined as the origin in a two-dimensional coordinate system, in which the boom extends along the ordinate, the angle α between the boom 8 and the lateral axis X of the cab 32 will simply correspond to the angle between the abscissa and the longitudinal axis Y of the cab 32. When the orientation of the cab 32 is known, the angle between the abscissa and the longitudinal axis Y of the cab 32 will be known. Using the first calibration procedure it is possible to provide a calibration curve, a calibration table or a mathematical formula, by which one can determine the a between the boom 8 and the lateral axis X of the cab 32 on the basis of data from the sensor assembly of the position detection device. Table 1 and the table shown in FIG. 11A show examples of corresponding angle and sensor data measurements.

2. A Second Calibration Procedure

Calibration of the sensor assembly can be done using a second calibration procedure, in which the orientation and position of the cab 32 is known during the entire calibration procedure. The position and orientation of the cab 32 can be measured using sensors available on the cab 32 or a structure fixed to the cab 32. The second calibration procedure comprises the step of arranging the excavator 6 in a position, in which the position of the shaft (to which the boom 8 is rotatably attached) is known. This can be done by positioning the shaft 14 and the fixed point on the bucket 4 in a known position on the ground. The second calibration procedure further comprises the step of measuring the absolute position of a point on the boom 8 or the bucket 4. The absolute position of a point on the stick 24, a boom 8 or the bucket 4 can be measured by means of a sensor (e.g. an antenna arranged and configured to receive satellite signals from one or more satellites and hereby measure the position). Using the second calibration procedure it is possible to provide a calibration curve, a calibration table (see table 1 or the table shown in FIG. 11A) or a mathematical formula, by which one can determine the a between the boom 8 and the lateral axis X of the cab 32 on the basis of data from the sensor assembly of the position detection device.

3. A Third Calibration Procedure

Calibration of the sensor assembly can be done using a third calibration procedure, in which the orientation and position of the cab 32 is known during the entire calibration procedure. The position and orientation of the cab 32 can be measured using sensors available on the cab 32 or a structure fixed to the cab 32. The third calibration procedure comprises the step of measuring a vector from a predefined point on the cab 32 or a structure fixed to the cab 32 to a fixed point on the stick 24, a boom 8 or the bucket 4. The vector can be measured by measuring the position of the points using an antenna arranged and configured to receive satellite signals from one or more satellites and hereby measure the position.

The third calibration procedure further comprises the step of comparing the orientation vector of the cab 32 or a structure fixed to the cab 32 and the vector from a predefined point on the cab 32 or a structure fixed to the cab 32 to a fixed point on the stick 24, a boom 8 or the bucket 4. The relative angle between these vectors corresponds to the a between the boom 8 and the lateral axis X of the cab 32. This procedure is carried out for a plurality of angles α between the boom 8 and the lateral axis X of the cab 32. By detecting the output of the sensor assembly of the position detection device for each angle α it is possible to provide a calibration curve as shown in FIG. 11B and FIG. 11C or a table (see table 1 or the table shown in FIG. 11A).

4. A Fourth Calibration Procedure

Calibration of the sensor assembly can be done using a fourth calibration procedure, in which gyroscopes placed on the boom 8 and/or bucket 4 and/or stick (or another structure attached thereto) are used to measure the relative angle of swing boom from a predetermined angle, here denoted the zero-point, although it could be any angle α.

When the boom 8 has been rotated to a predetermined angle such as the zero angle (e.g. defined by this initial orientation of the boom 8). Any further rotation of the boom 8 may then be tracked by at least one sensor that is affected by a change in the angle α). The sensor may be a gyroscope located on the boom, the stick, the bucket 4 (or another structure attached thereto). A gyroscope only provides information about relative change in the angle α. However, since the gyroscope was used to measure an angular displacement starting from a zero angle, the measurement will correspond to the absolute angle α. By detecting the output of the sensor assembly of the position detection device for each angle α it is possible to provide a calibration curve as shown in FIG. 11B and FIG. 11C or a table (see table 1 or the table shown in FIG. 11A).

5. A Fifth Calibration Procedure

Calibration of the sensor assembly can be done using a fifth calibration procedure, in which one or more accelerometers and/or gyroscopes and/or magnetometers placed on the stick 24, a boom 6 or the bucket are used together with one or more accelerometers and/or gyroscopes and/or magnetometers positioned on the cab 32 or a structure fixed to the cab 32 to measure the angle α.

This method is in particular suitable when the cab 32 is arranged on a non-horizontal surface. When the excavator 6 is positioned in a position in which the longitudinal axis Z of the shaft 14 is not parallel (or anti-parallel) with the gravity vector. In this situation it is possible to calculate the angle α directly from a three-axis accelerometer located on the part of the excavator 6 that is affected by a change in the angle α. Alternatively, if the longitudinal axis Z of the shaft 14 is parallel or almost parallel to the gravity vector, a magnetometer and/or compass may be employed instead of one or more accelerometers and/or gyroscopes and/or magnetometers. By detecting the output of the sensor assembly of the position detection device for each angle α it is possible to provide a calibration curve as shown in FIG. 11B and FIG. 11C or a table (see table 1 or the table shown in FIG. 11A).

Generally, the orientation of the cab 32 can be detected in several ways.

In an embodiment, the orientation of the cab 32 can be detected using two GNSS antennas arranged and configured to receive satellite signals from one or more satellites.

In an embodiment, the orientation of the cab 32 can be detected using a single GNSS antenna in combination with a 3-D position detection device (e.g. 3D position sensor). In an embodiment, the 3-D position detection device is a laser sensor.

In an embodiment, the orientation of the cab 32 can be detected using a single absolute position (e.g. detected by an antenna arranged and configured to receive satellite signals from one or more satellites) in combination with a detection of a rotation of the excavator 6.

In an embodiment, the orientation of the cab 32 can be detected using a compass.

The position of a known point on cab 32 can be obtained from an antenna arranged and configured to receive satellite signals from one or more satellites.

The position of the pivot point (the shaft 14) can be calculated using information about orientation of the cab 32, the pitch and roll of the cab 32 and a position on the cab 32 or a structure fixed to the cab 32 e.g. in combination with a forward, side and down length from a measuring point to the pivot point (the shaft 14).

The absolute position of a point on the boom 6 or the bucket 4 can be measured using an antenna (arranged and configured to receive satellite signals from one or more satellites) fixed on the boom 6 or bucket 4.

FIG. 11A illustrates a table with corresponding sensor data from a sensor assembly of a position detection device according to the invention and angular data determined using the method according to the invention. The data can be provided using one of the protocols referred to as:

A first calibration procedure;

A second calibration procedure;

A third calibration procedure;

A fourth calibration procedure; or

A fifth calibration procedure;

It is also possible to generate a mathematical formula describing the relationship between the sensor data and the angular data.

FIG. 11B illustrates a graph depicting the angle α of the boom as a function of the distance D measured by the sensor assembly of a position detection device according to the invention. It can be seen that the points almost lie on a straight line. Accordingly, it is possible to describe the relationship between the sensor data (the measured distance D) and the angular data by an equation. In the particular example of FIG. 11B the equation used to describe the relationship between sensor data and angular data was a linear model: $\alpha=a_1D+b_1$. It has to be emphasized that a line is only an example, and that different models (instead of a line) can be applied. It is possible to interpolate or extrapolate instead of fitting to a mathematical model such as a line. Any suitable mathematical model may be applied. Moreover, any suitable number of table entries may be used.

In practice, the points will typically not be on a straight line.

FIG. 11C illustrates a graph depicting the angle α of the boom as a function of the output data U from a sensor assembly of a position detection device according to the invention. In this illustrative example it can be seen that the points almost lie on a straight line. Accordingly, it is possible to describing the relationship between the sensor data (the measured distance D) and the angular data by an equation for a line as indicated: $\alpha=a_2U+b_2$.

LIST OF REFERENCE NUMERALS

2 Position detection device
4 Bucket
6 Excavator
8, 8' Boom
10 Sensor assembly
12 Mounting structure
14 Shaft
16 Wire
18 Wire sensor
20 Antenna (GNSS receiver)
22 Driving assembly
24 Stick
26, 26', 26" Cylinder
28, 28' Cylinder joint
30, 30', 30'" Boom joint
32 Cab
34 Rotation cylinder
36, 36' Track
38 Wire sheath
40 Sheath mount
42 Mounting bracket
44 Cover
46 Control unit
X Lateral axis
Y, B, Z Longitudinal axis
$P_1$, $P_2$ Point
D Distance
α Angle
U Output data (e.g. a voltage)

What is claimed is:

1. A position detection device for detecting the position of a bucket of an excavator that has a cab and an arm comprising a boom rotatably attached to the cab by a mounting structure that is rotatably attached to the cab by a shaft having a longitudinal axis extending vertically relative to ground, the position detection device comprising:

one or more 3-D positioning devices arranged and configured to receive satellite signals from one or more satellites;

a sensor assembly that measures a quantity related to rotation of the boom about the longitudinal axis of the shaft and determines an angular position of the boom with respect to rotation about the longitudinal axis of the shaft on the basis of the measured quantity, wherein the quantity is a distance between the cab and the mounting structure; and a control unit that calibrates the sensor assembly.

2. The position detection device according to claim 1, wherein the sensor assembly measures the distance between a fixed position on the cab or a structure attached thereto and a fixed position on the mounting structure or a structure attached thereto.

3. The position detection device according to claim 1, wherein the sensor assembly comprises a wire sensor and the control unit calibrates the sensor assembly using a predefined list of wire lengths corresponding to a plurality of predefined rotational positions of the boom.

4. The position detection device according to claim 1, wherein the sensor assembly comprises two spaced apart mounting brackets and a wire sheath extending between two sheath mounts arranged at each end of the wire sheath, wherein a wire is slidably arranged in the wire sheath and extends in extension thereof.

5. The position detection device according to claim 1 further comprising a display unit configured to display rotation of the mounting structure with respect to the longitudinal axis of the shaft.

6. The position detection device according to claim 1, wherein the control unit calibrates the sensor assembly by measuring the angular position of the boom with respect to rotation about the longitudinal axis of the shaft using a predefined protocol and detecting output from the sensor assembly for a plurality of configurations having different angular positions.

7. The position detection device according to claim 6, wherein the predefined protocol applies one or more measurements selected from a)-d) to detect the angular position:

a) orientation and position of the cab measured using sensors available on the cab or a structure fixed to the cab;

b) orientation of the boom;

c) position of the longitudinal axis of the shaft; and/or d) position of a fixed point on a stick, the boom, or the bucket.

8. An excavator comprising a position detection device according to claim 1.

9. A method for determining a position of a bucket of an excavator that has a cab and an arm comprising a boom rotatably attached to the cab by a mounting structure that is rotatably attached to the cab by a shaft having a longitudinal axis extending vertically relative to ground, the method comprising:

calibrating a sensor assembly by measuring an angular position of the boom with respect to rotation about the longitudinal axis of the shaft using a predefined protocol, wherein the angular position is determined by measuring a quantity related to rotation of the boom about the longitudinal axis of the shaft, wherein the quantity is a distance between the cab and the mounting structure; and detecting output from the sensor assembly for a plurality of configurations of the excavator corresponding to different angular positions.

10. The method according to claim 9, wherein the distance between the cab and the mounting structure is measured using a wire sensor.

11. The method according to claim 9, wherein the predefined protocol applies one or more measurements selected from a)-d) to detect the angular position:

a) orientation and position of the cab measured using sensors available on the cab or a structure fixed to the cab;

b) orientation of the boom;

c) position of the longitudinal axis of the shaft; and/or d) position of a fixed point on a stick, the boom, or the bucket.

12. The method according to claim 9, wherein calibrating the sensor assembly comprises determining the position of the cab using a number of sensors available on the cab or a structure rigidly fixed to the cab.

13. The method according to claim 9, wherein calibrating the sensor assembly comprises:

placing the excavator in a position, in which the position of the shaft and a fixed point on the arm are known; and rotating the arm with respect to the shaft into a plurality of different angular positions relative to a lateral axis of the cab;

wherein for each of the plurality of different angular positions an angle between the arm and the lateral axis of the cab is determined.

14. The method according to claim 9, wherein calibrating the sensor assembly comprises:

arranging the excavator in a position, in which the position of the shaft is known;

measuring an absolute position of a point on the arm; and rotating the arm with respect to the shaft into a plurality of different angular positions relative to a lateral axis of the cab;

wherein for each of the plurality of different angular positions an angle between the arm and the lateral axis of the cab is determined.

15. The method according to claim 9, wherein calibrating the sensor assembly comprises:

measuring a vector extending between a predefined point on the cab or a structure rigidly fixed to the cab and a fixed point on the arm, positions of the predefined point and the fixed point being determined by a GNSS antenna arranged and configured to receive satellite signals from one or more satellites;

comparing an orientation vector of the cab and the vector extending between the predefined point and the fixed point on the arm; and repeating the steps of measuring and comparing for a plurality of different angles between the arm and a lateral axis of the cab.

16. The method according to claim 9, wherein calibrating the sensor assembly uses a number of gyroscopes placed on the arm to measure a relative angle of the arm from a predetermined point, wherein measurement of the relative angle is carried out for a plurality of different angles between the arm and a lateral axis of the cab.

17. The method according to claim 9, wherein calibrating the sensor assembly uses one or more accelerometers and/or gyroscopes and/or magnetometers placed on the arm together with one or more accelerometers and/or gyroscopes and/or magnetometers positioned on the cab or a structure rigidly fixed to the cab to measure an angle, wherein measurement of the angle is carried out for a plurality of different angles between the arm and a lateral axis of the cab.

* * * * *